United States Patent [19]

Moore et al.

[11] Patent Number: 5,000,346

[45] Date of Patent: Mar. 19, 1991

[54] METHOD AND APPARATUS FOR DISPENSING NEWSPAPERS

[75] Inventors: Harry O. Moore, 2921 Rozzells Ferry Rd., Charlotte, N.C. 28216; David L. Furr, III, Indian Trail, N.C.

[73] Assignees: Harry O. Moore; Chris Combis, Charlotte, N.C.

[21] Appl. No.: 514,200

[22] Filed: Apr. 25, 1990

[51] Int. Cl.[5] ..... G07F 11/16

[52] U.S. Cl. ..... 221/215; 221/213; 221/198; 221/232; 221/195; 221/281; 221/155; 312/270

[58] Field of Search ..... 312/270, 275; 198/721; 221/197, 198, 213–216, 232, 195, 281, 155

[56] References Cited

U.S. PATENT DOCUMENTS

| | | | |
|---|---|---|---|
| 1,600,623 | 9/1926 | Chesnut et al. | 221/216 |
| 1,892,476 | 12/1932 | Straubel | 312/275 |
| 2,444,389 | 6/1948 | Wagner | 221/215 |
| 2,876,884 | 3/1959 | Ray | 221/214 |
| 3,051,286 | 8/1962 | Starge et al. | 221/232 |
| 3,180,518 | 4/1965 | Roser | 221/232 |
| 3,225,961 | 12/1965 | Parks | 221/214 |
| 3,302,830 | 2/1967 | Huggin et al. | 221/216 |
| 4,298,140 | 11/1981 | Owens | 221/232 |
| 4,318,468 | 3/1982 | Bodewes et al. | 198/721 |

*Primary Examiner*—H. Grant Skaggs
*Attorney, Agent, or Firm*—Ralph H. Dougherty

[57] ABSTRACT

Apparatus and method for individually dispensing an item such as a newspaper from among a set of items. The dispensing machine includes a mechanism for individually dispensing an item from among a vertically stacked set of items; a money collection device for activating the dispensing mechanism upon payment of particular sum of money, and a housing containing the dispensing mechanism and the money collection device. Each article is urged against the front of the machine, and upon activation, is lifted slightly to clear a barrier, then discharged to the exterior of the machine.

16 Claims, 6 Drawing Sheets

METHOD AND APPARATUS FOR DISPENSING NEWSPAPERS

BACKGROUND OF THE INVENTION

1. Field of the Invention

The present invention generally relates to dispensing articles and, more particularly, is concerned with an apparatus and method for dispensing items such as newspapers, magazines, and the like, in single copy fashion.

2. Description of the Prior Art

Newspaper vending machines are commonplace throughout the United States. The usual type of machine is operated by depositing an appropriate amount of money into the machine, opening the door of the machine, and removing one of the many accessible newspapers. Although multiple newspaper copies are accessible to the operator of the machine, the intention is that the operator will remove only the number of copies appropriate for the amount of money deposited.

Despite the fact that many patents have issued for vending machines which will vend a single newspaper at a time, the most commonly used coin operated newspaper vending machine in general use today remains the type which contains a stack of newspapers therein and has a coin operated door which allows the door to be opened when sufficient coins are deposited to pay for only a single newspaper. However, once the door is opened, all of the newspapers remaining in the vending machine are at risk. This conventional type of vending machine or box has a door which is spring loaded, so that it can not be left in the open position. A source of irritation to some customers is that they lose their grip on the door after having paid for a paper, upon which occurrence the door slams closed and full payment must be made to reopen the door.

Single copy newspaper dispensing machines have been proposed before. Upon deposit of an appropriate predetermined amount of money, they dispense a single newspaper copy only.

The applicants are aware of the following U.S. Patents relating to dispensing machines:

| U.S. PAT. NO. | INVENTOR | ISSUE DATE | TITLE |
|---|---|---|---|
| 4,865,178 | Lewandowski | 9/12/89 | SINGLE COPY VENDING MACHINE FOR NEWSPAPERS AND THE LIKE |
| 4,802,606 | Daniels | 2/7/89 | NEWSPAPER DISPENSER |
| 4,700,869 | Bogner | 10/20/87 | SINGLE ITEM VENDING MACHINE |
| 4,654,513 | Hennessy | 3/31/87 | NEWSPAPER VENDING MACHINE |
| 4,625,894 | James, et al. | 12/2/86 | NEWSPAPER VENDING MACHINE |
| 4,544,081 | Voegeli | 10/1/85 | NEWSPAPER DISPLAY MACHINE |
| 4,506,800 | Wingate | 3/26/85 | MACHINE FOR VENDING ARTICLES SUCH AS NEWSPAPERS, MAGAZINES AND THE LIKE |
| 4,389,000 | Godley, et al. | 6/21/83 | NEWSPAPER VENDING MACHINE |
| 4,312,461 | Godley, Sr. | 1/26/83 | NEWSPAPER VENDING MACHINE |
| 4,139,120 | Moore | 2/13/79 | VENDING APPARATUS FOR NEWSPAPERS AND ANALOGOUS ARTICLES |
| 3,998,358 | Moore | 12/21/76 | APPARATUS FOR DISPENSING ARTICLES SUCH AS NEWSPAPERS AND THE LIKE |
| 3,907,160 | Moore | 9/23/75 | APPARATUS FOR DISPENSING ARTICLES SUCH AS NEWSPAPERS AND THE LIKE |

Lewandowski, Daniels, and Bogner each relate to a newspaper dispenser for vending a single item from a horizontally stacked set of items.

Hennessy relates to a newspaper vending machine for dispensing a single newspaper from a slanted or inclined stack of newspapers.

James discloses a newspaper vending machine for dispensing a plurality of folded rectangular newspapers disposed substantially upright and adjacent to each other.

Voegeli relates to a display machine of the type including a coin actuated unlocking device for dispensing articles to be sold.

Wingate relates to a machine for vending articles such as newspapers, magazines and the like.

Godley et al. and Godley, Sr. both relate to newspaper vending machines having vertically movable inclined platforms for supporting a group of newspapers and dispensing thereof.

The Moore Patents ('120, '358, '160) each relate to apparati for dispensing articles such as newspapers and the like wherein an article supporting means supports a stack of superimposed articles inclined downwardly and forwardly at an angle for facilitating dispenses of the articles one at a time from the stack.

However, none of the patented machines have ever met with commercial success because newspapers are printed in thicknesses which vary from day to day. Thus, a vending machine must be able to accommodate newspapers having substantially differing number of pages.

The described shortcomings of existing inventions demonstrate a need for a novel apparatus and method for dispensing newspapers in single copy fashion. The present invention is such an apparatus and a method for accomplishing its operation.

SUMMARY OF THE INVENTION

In summary, the invention relates to an apparatus and method for individually dispensing an item from among a vertically stacked set of items. A money collection device activates the dispensing apparatus upon payment of particular sum of money. A housing contains the dispensing apparatus and the money collection device.

OBJECTS OF THE INVENTION

The principal object of the invention is to provide an improved apparatus for dispensing newspapers, magazines, or the like.

A further object of this invention is to provide an apparatus and method for dispensing newspapers, magazines, or the like, in a single copy fashion.

Another object of the invention is to provide an invention for dispensing newspapers, magazines, or the like, having a large variation or range of number of pages in the item.

Another object of the invention is to provide an invention for dispensing newspapers, magazines, or the like, that is secure against theft.

DESCRIPTION OF THE PREFERRED EMBODIMENT

Figure 1:
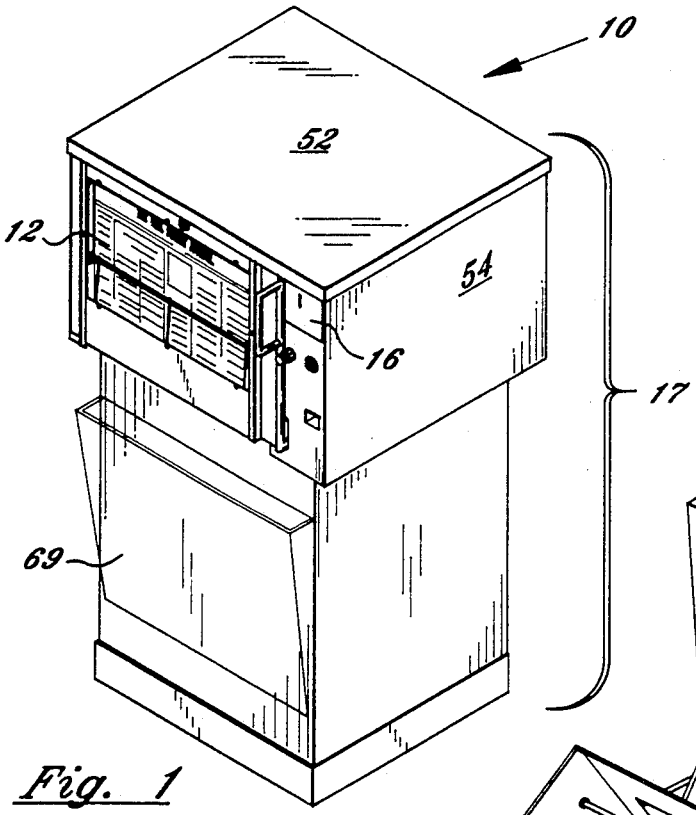
FIG. 1 is a perspective view of the dispensing machine.

Referring now to the drawings, and particularly to FIG. 1, the invented apparatus 10 for individually dispensing an item 12 from among a set of items includes means 14 for individually dispensing an item 12 from among a vertically stacked set of items, a money collection device 16 for activating the dispensing means 14 upon payment of particular sum of money, and a housing 17 containing the dispensing means 14 and the money collection device 16.

The dispensing means 14 includes a cam bar assembly 18, a first lift mechanism 20 situated beneath the cam bar assembly 18, and a rachet handle 22 connected to the first lift mechanism 20.

The rachet handle 22 is connected to a first lift mechanism 20 which includes an anchoring means 24, first and second lift bars 26, 28 having a lift roller 30 attached thereto, the first lift bar 26 being anchored to the anchoring means 24. A rachet 32 and a paw 34, also anchored to the anchoring means 24, are connected to each other by a spring 36. The rachet 32, paw 34, and spring 36, in combination, interact with the first lift bar 26. The first lift mechanism 20 is situated beneath a cam bar assembly 18 which includes first and second cam bars 38, 40, a swivel cam 42, and a connecting bar 44 connecting the first cam bar 38 to the swivel cam 42. The connecting bar 44 is fitted with pointed papergrasping pins, or "needles", 46 depending downwardly from the bar 44 and toward the interior of the upper compartment for engagement with an individual item 12. The first lift mechanism 20, generally, and the lift roller 30, specifically, is adapted for contact with both the first and second cam bars 38, 40. The back portion of the cam assembly 18 is pivotally mounted to the housing 17. The connecting bar 44 is adapted for contact with the swivel cam 42. The swivel cam 42 defines a path followed by the connecting bar 44 which angles the needles 46 depending from the connecting bar 44 into contact with an individual item 12 to be dispensed. The needles 46 are adapted to draw the item 12 upward. Concurrently with drawing the item 12 upward, the remaining set of items are urged forward to occupy the space left by the upwardly drawn item 12. The paper transport 47 includes a vertically oriented article follower plate, or back plate, 48 and compensating plate 50. The compensating plate is centrally and loosely attached to the back plate to allow it to cant and compensate for a greater thickness of the stack at one end, in newspapers, the end with the fold.

The housing 17 includes a base 51, a lower compartment 53 upstanding from the base 51, an upper compartment 54 above the lower compartment 53 for housing the dispensing means 14, and a top cover 52 encasing the top portion of the upper compartment 54.

Figure 2:
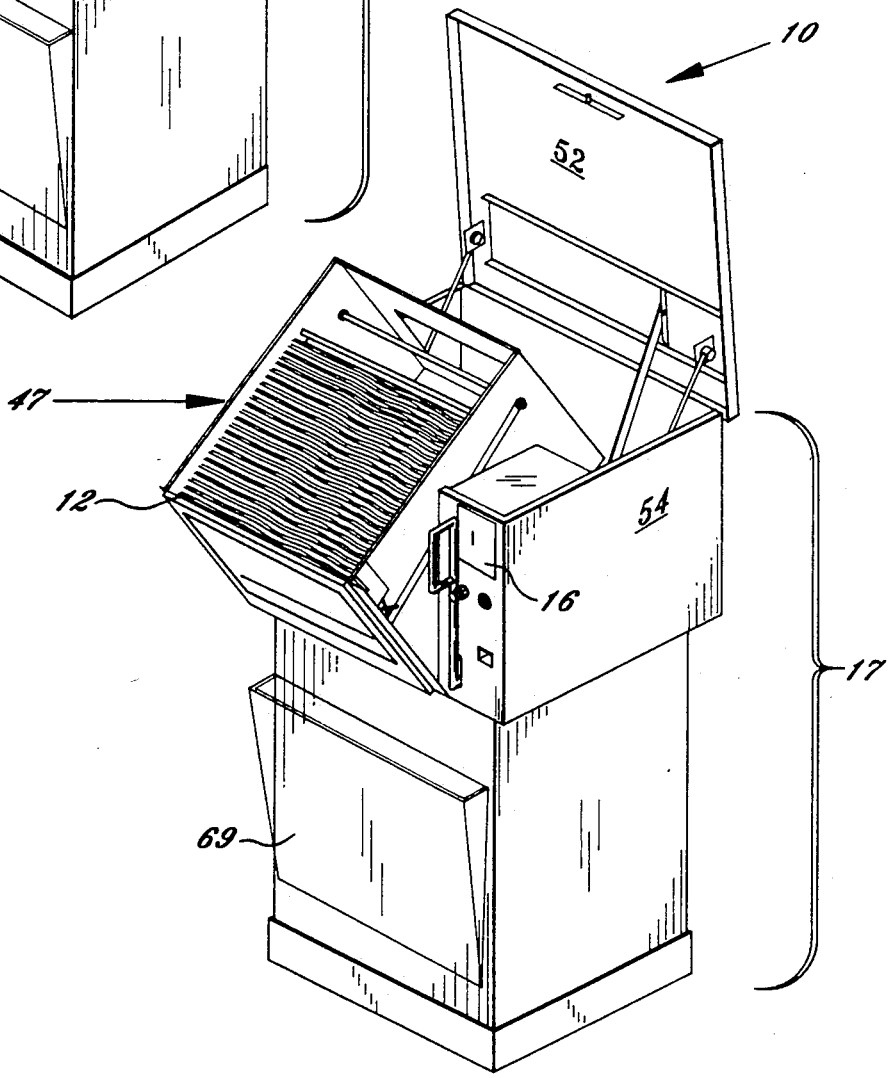
FIG. 2 is a perspective view of the machine shown in FIG. 1, with the dispensing mechanism shown ready for loading.
Figure 3:
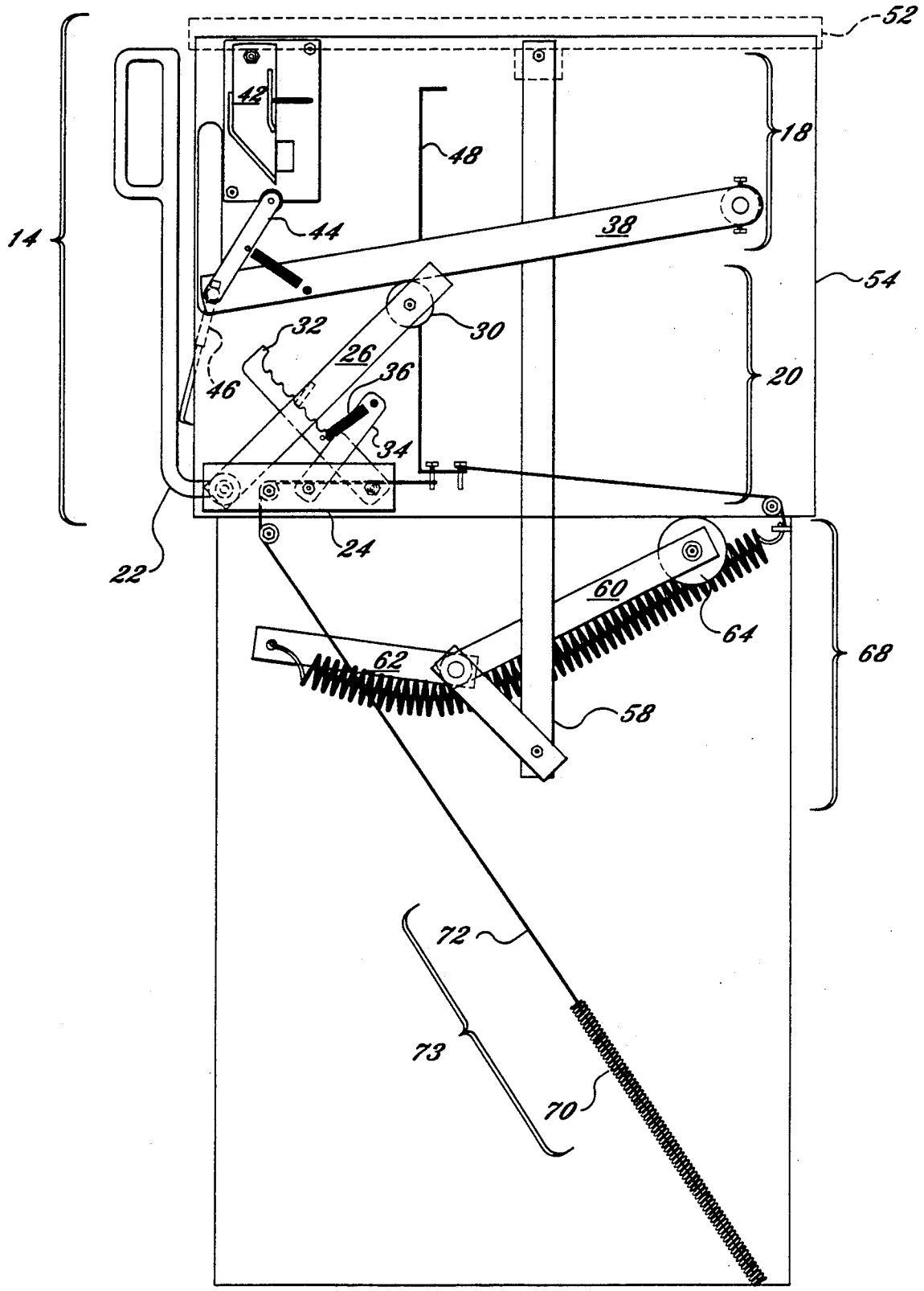
FIG. 3 is a cross-sectional side view the dispensing machine shown in FIG. 1.
Figure 4:
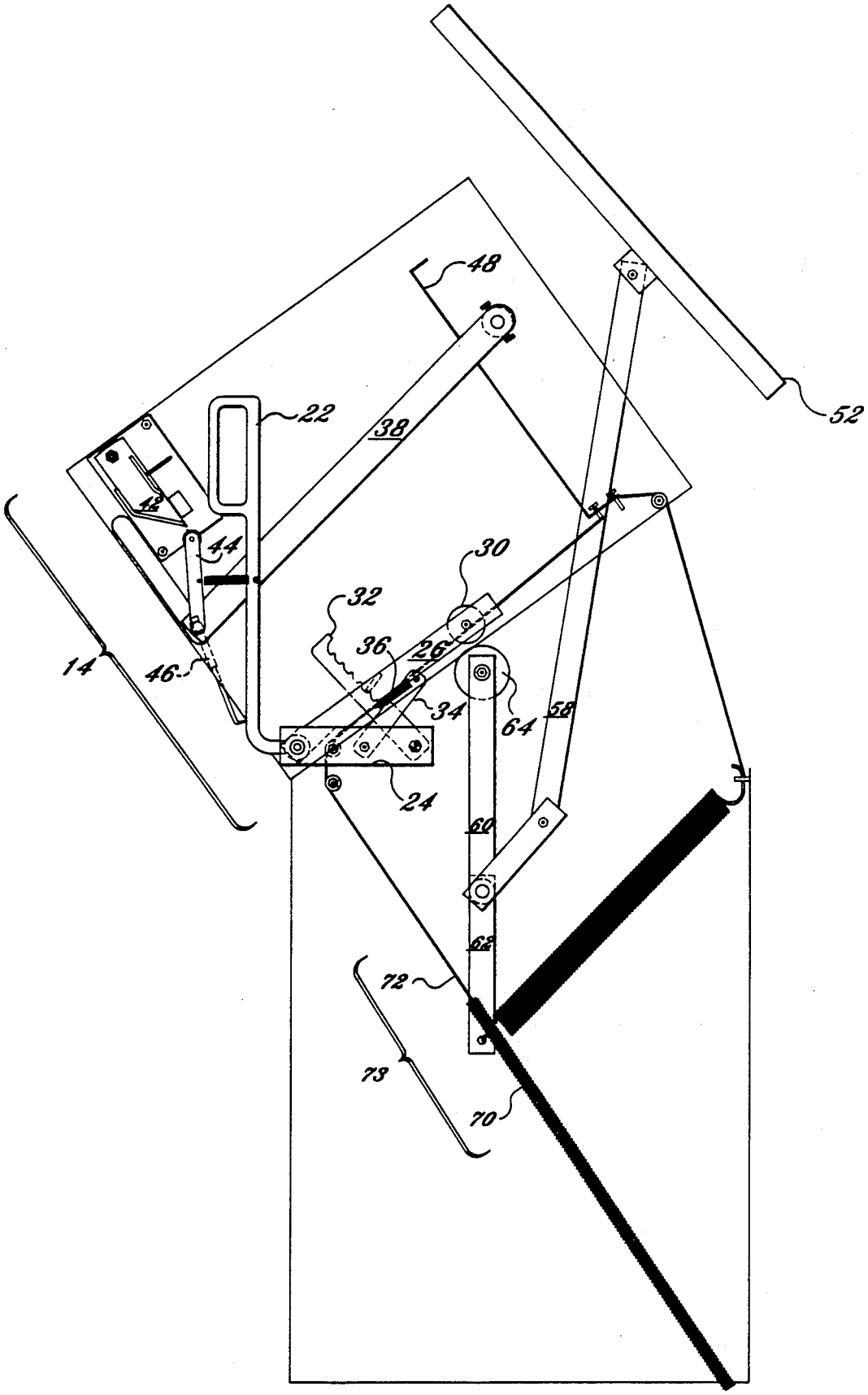
FIG. 4 is a cross-sectional side view the newspaper dispensing machine shown in FIG. 2.
Figure 5:
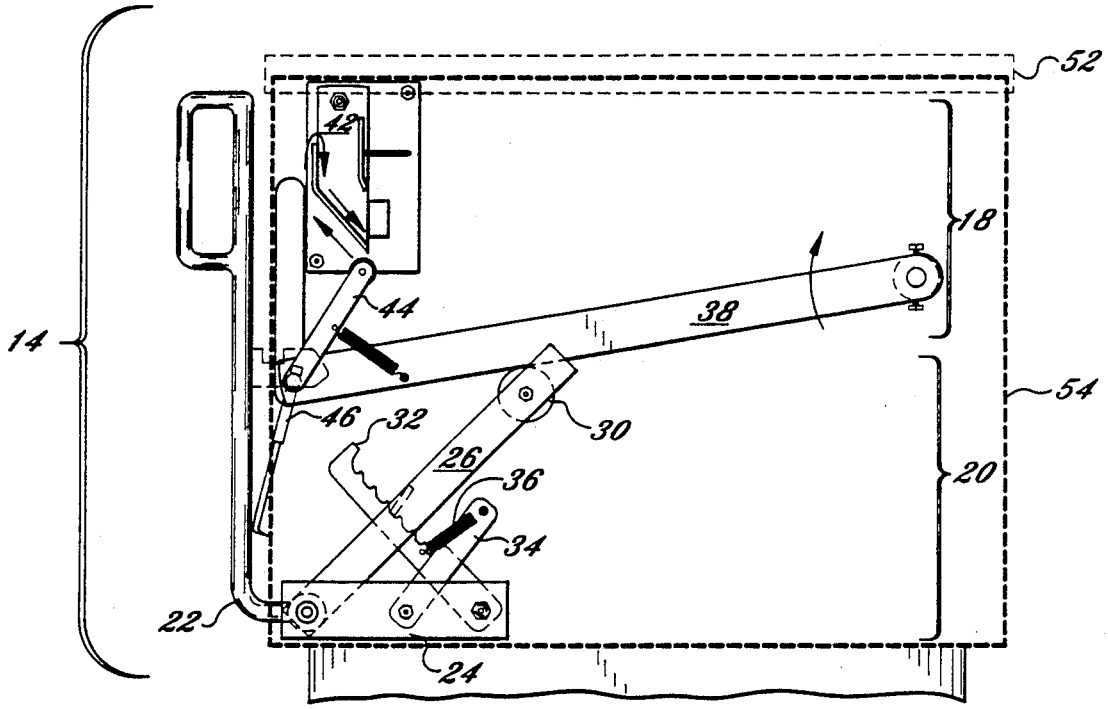
FIG. 5 is a cross-sectional side view of the top compartment of the dispensing machine, illustrating the initial position of the apparatus.
Figure 6:
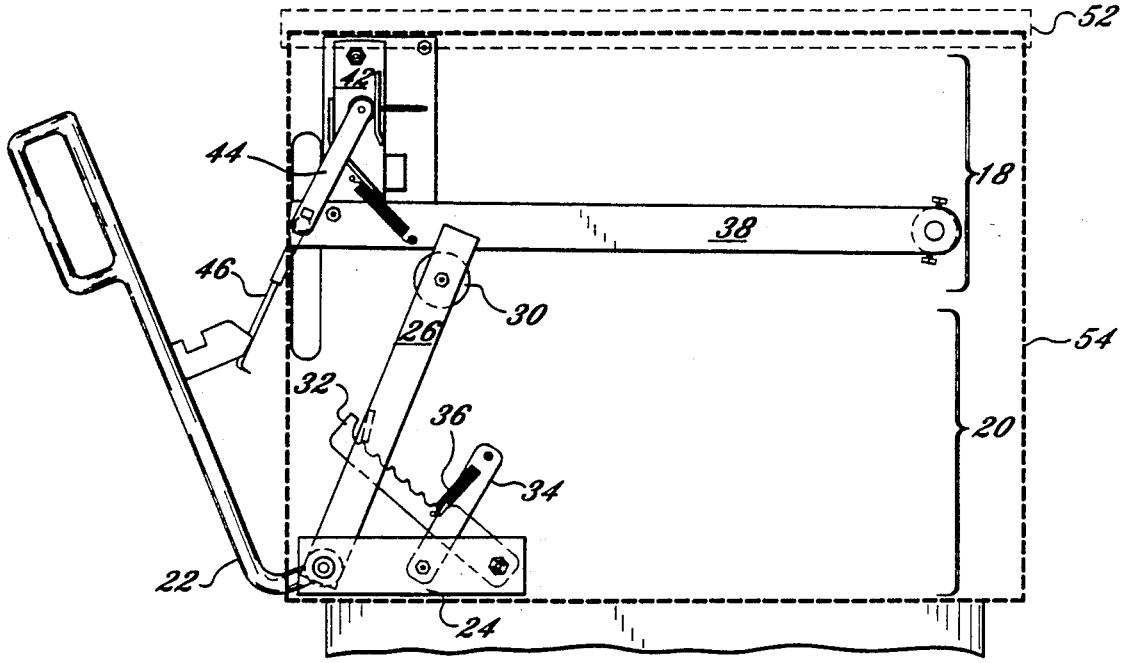
FIG. 6 is a cross-sectional side view of the top compartment of the dispensing machine, illustrating the position of the machine after engagement of the rachet handle.
Figure 7:
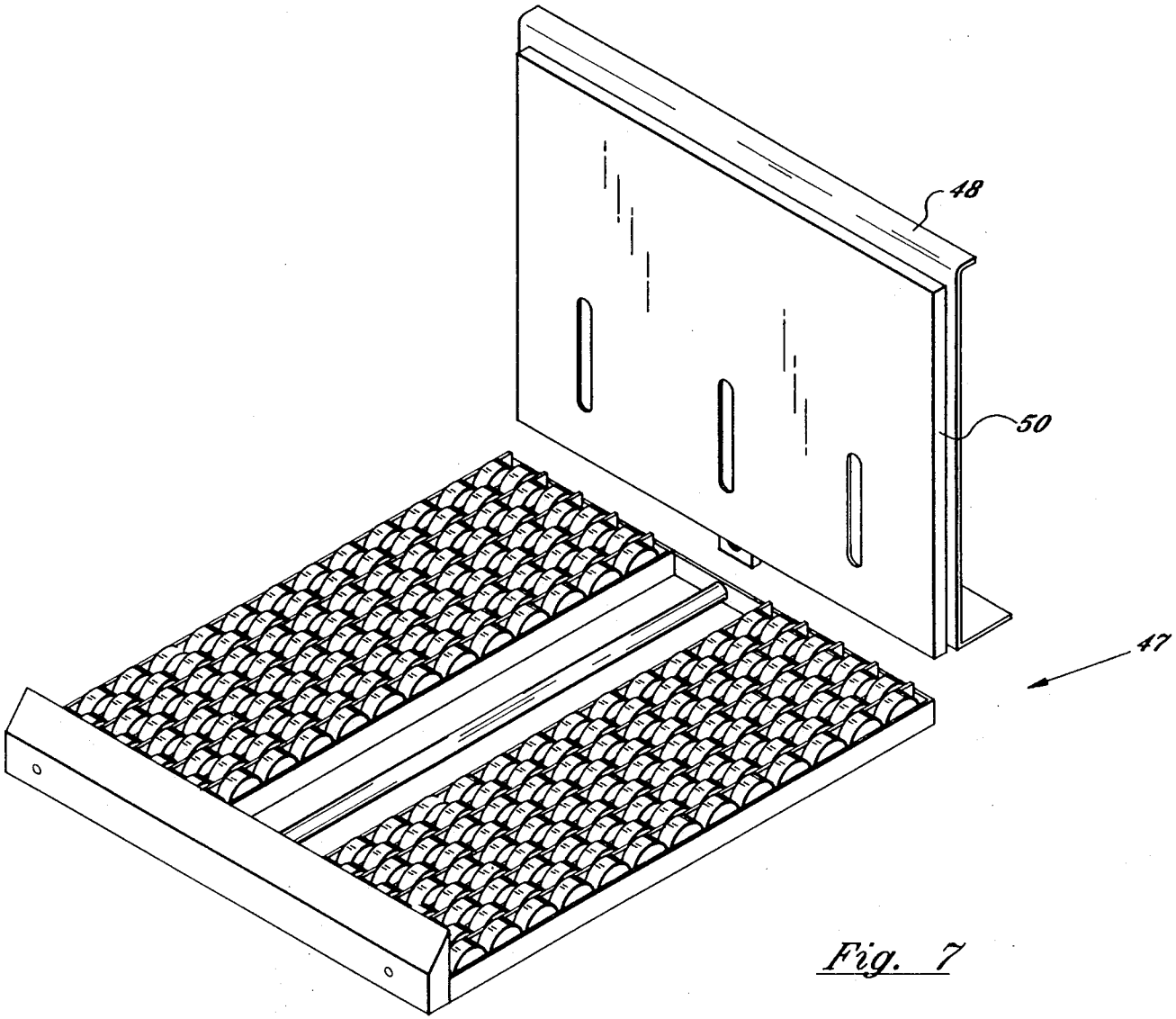
FIG. 7 is a perspective view of the paper transport unit.
Figure 8:
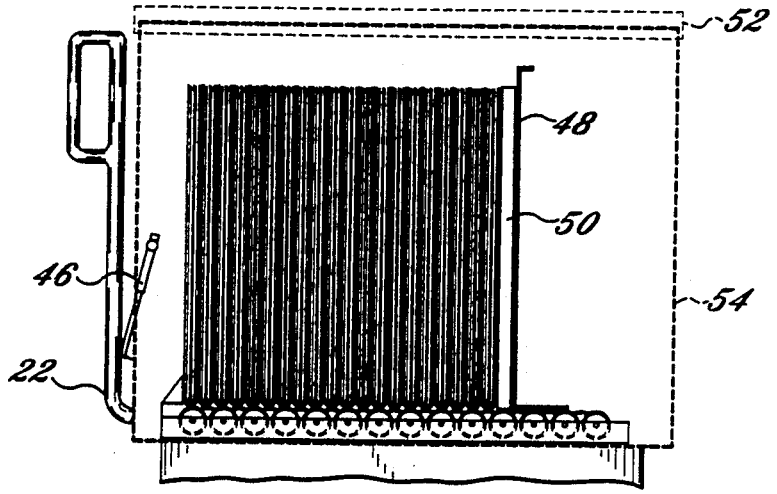
FIG. 8 is a cross-sectional side view of the top compartment of the dispensing machine, illustrating the initial position of the apparatus.
Figure 9:
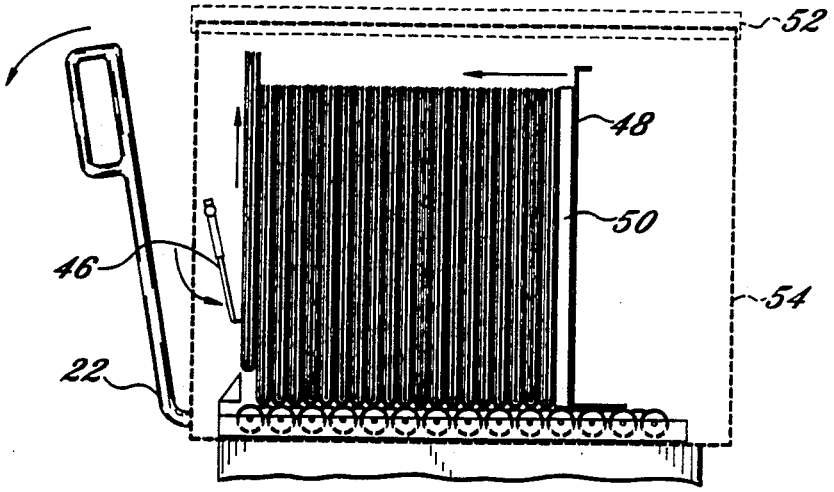
FIG. 9 is a cross-sectional side view of the top compartment of the dispensing machine, illustrating the position of the machine after engagement of the rachet handle.
Figure 10:
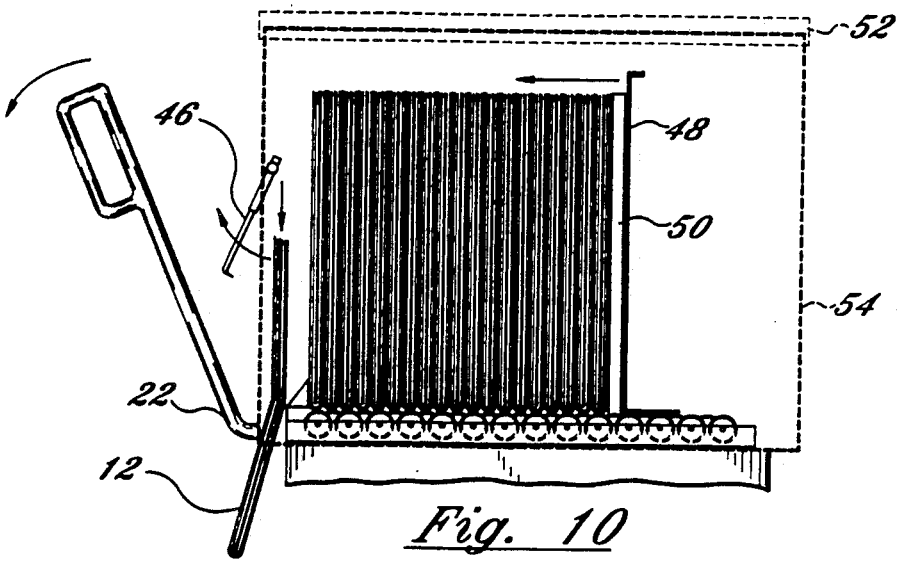
FIG. 10 is a cross-sectional side view of the top compartment of the dispensing machine, illustrating the machine dispensing an item.

The top cover 52 is pivotally attached to the rear edge of the upper compartment 54. The top cover 52 is connected to a transport lift assembly 56 which includes a transport lift connecting bar 58, transport lift bars 60, 62 having a transport lift roller 64 attached thereto, an auxiliary bar 66 connecting the transport lift connecting bar 58 to the transport lift bars 60, 62. Pulling the top cover 52 upward from the dispensing machine 10 causes the second lift mechanism 68 to be urged forward towards the front of the dispensing machine 10. The second lift mechanism 68, generally, and the transport lift roller 64, specifically, are adapted to make contact with the underside of the transport unit 47. The rear portion of the transport unit 47 is pivotally mounted to the housing 17. The transport unit 47 is thus tiltable, as shown in FIGS. 2 and 4. The back plate 48 is concurrently urged to the back of the transport unit 47 by a spring 70 and cable 72 forming a spring and cable system 73. The back plate has a depending bearing block 48*a* with an orifice or slot adapted to engage linear guide rod 49. An upwardly tapering front stop 47*c* is provided at the discharge end of the transport unit. Rollers 47*d* are contained in a roller support assembly in a multiplicity of lines of closely spaced rollers, adjacent lines of rollers being offset from one another.

In operation, a predetermined sum of money is deposited in the money collection device 16. If the sum of money is adequate to purchase an item 12, the dispensing machine 10 is activated by disengaging the rachet handle 22 from the money collection device 16, which enables the rachet handle 22 to be pulled outwardly from the dispensing machine 10. Any excess money deposited is returned to the user. Pulling the rachet handle 22 away from the dispensing machine 10 causes the first lift mechanism 20 to be urged forward towards the front of the dispensing machine 10. The first lift mechanism 20, generally, and the lift roller 30, specifically, makes contact with both the first and second cam bars 38, 40. As the lift bars 26, 28 move towards the front of the dispensing machine 10, the front portion of the cam assembly 18 is pivotally urged upwardly toward the top of the machine 10. The connecting bar 44 is thus forced into contact with the swivel cam 42. Engagement of the connecting bar 44 with the swivel cam 42 forces the needles 46 into contact with an individual article 12 to be dispensed. The paper-grasping needles actually penetrate the first few sheets of a paper article or the exterior sheet of a plastic cover on an article being dispensed. As the connecting bar 44 continues the journey along the path defined by the swivel cam 42, the item 12 is drawn upward. The set of newspapers or other items are concurrently urged forward to occupy in the space left by the upwardly drawn item 12. Upon disengagement of the connecting bar 44 from the swivel cam 42, the needles 46 disengage from the item 12 to be dispensed, the item 12 falls due to gravity into a receptacle 69, the first lift bar 26 disengages from the rachet 32, and the lift mechanism 20 returns to its initial position. Upon release of the rachet handle 22, the rachet handle 22 is reengaged by the money collection device 16 and the dispensing machine 10 is ready to dispense another item 12.

To load the dispensing machine 10 with a set of items 12, the top cover 52, pivotally attached to the rear edge of the upper compartment 54, is lifted upward. Pulling the top cover 52 upward from the dispensing machine 10 causes the second lift mechanism 68 to be urged forward towards the front of the dispensing machine 10. The second lift mechanism 68, generally, and the transport lift roller 64, specifically, makes contact with the underside of the transport unit 47. As the transport lift bars 60, 62 move towards the front of the dispensing machine 10, the rear portion of the transport unit 47 is pivotally urged upward towards the top of the machine 10, thus tilting the transport unit 47 outwardly, as shown in FIGS. 2 and 4. The back plate 48 is concurrently pulled to the back of the transport unit 47 by a spring 70 and cable 72 system. Closing the top cover 52 reverses the process and returns the dispensing machine 10 to its initial operating position.

SUMMARY OF THE ACHIEVEMENT OF THE OBJECTS OF THE INVENTION

From the foregoing, it is readily apparent that we have invented an improved method and apparatus for dispensing a single copy of a newspaper, magazine, or the like, from a stack of like articles, that is secure against theft.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

We claim:

1. Apparatus for individually dispensing an article through a discharge opening from a stacked set of at least one vertically oriented upright article, comprising:

(a) a housing including a base, a lower compartment upstanding from said base, an upper compartment above said lower compartment, a top cover encasing the top portion of said upper compartment and hingedly connected to said housing at the rear thereof;

(b) means for dispensing a single article from said set, said dispensing means including:

(i) article-containing means within said upper compartment for containing said set, (ii) means for grasping a single article and discharging said article to the exterior of said housing through said discharge opening, and (iii) means for urging an upright article toward said discharge opening;

(c) means associated with said top cover for tilting said containing means outwardly from said upper compartment for loading of articles into said apparatus; and (d) means associated with said dispensing means, for activating said dispensing means.

2. The dispensing apparatus according to claim 1, wherein said containing means includes a base having an integral article roller support assembly for movement of articles thereon.

3. The dispensing apparatus according to claim 2, wherein said roller support assembly comprises a multiplicity of lines of closely spaced rollers, adjacent lines of rollers being offset from one another.

4. The dispensing apparatus according to claim 1, wherein said grasping means includes:

(a) a cam bar assembly;

(b) a first lift mechanism situated beneath and engageable with said cam bar assembly;

(c) a rachet handle connected to said first lift mechanism for engaging said first lift mechanism; and (d) a plurality of article engaging pins mounted for rotation on a horizontal bar integral with said cam bar assembly.

5. The dispensing apparatus according to claim 1, further comprising an article receiving receptacle mounted exterior of said housing beneath said discharge opening.

6. The dispensing apparatus according to claim 5, wherein said biasing means is a spring and cable system.

7. The dispensing apparatus according to claim 5, further comprising a compensating plate centrally attached to said follower plate, on the face nearer the articles.

8. The dispensing apparatus according to claim 1, wherein said urging means is a vertically oriented article follower plate having associated biasing means.

9. The dispensing apparatus according to claim 1, wherein said means associated with said dispensing means for activating said dispensing means is a money collection device, whereby said dispensing means is activated upon insertion of a predetermined sum of money therein.

10. The dispensing apparatus according to claim 1, wherein said housing includes means for viewing a portion of at least one said vertically oriented upright articles.

11. The dispensing apparatus according to claim 10, wherein said viewing means is a window positioned on the front of said upper compartment adapted for viewing the front of the next article to be dispensed.

12. A method for individually dispensing an article from among a vertically stacked set of articles within a dispensing machine, comprising the steps of:

(a) activating the dispensing function:
(b) urging a first lift mechanism forward towards the front of the dispensing machine;
(c) engaging a first lift bar with a rachet;
(d) pivotally urging the front portion of a cam assembly upward towards the top of the machine as the first lift bar moves towards the front of the dispensing machine;
(e) forcing a connecting bar into contact with a swivel cam;
(f) engaging the connecting bar with the swivel cam thereby forcing a grasping mechanism into contact with an individual article to be dispensed;
(g) drawing the article upward as the connecting bar continues its journey along the path defined by the swivel cam;
(h) urging the set of articles forward to occupy the space vacated by the upwardly drawn article;
(i) upon disengagement of the connecting bar from the swivel cam, disengaging the grasping mechanism from the article to be dispensed, and permitting the article to fall by gravity into a receptacle;
(j) disengaging the first lift bar from the rachet; and
(k) returning the lift mechanism to its initial position.

13. The dispensing method according to claim 12, wherein the step of activating the dispensing machine comprises the steps of:

(a) depositing a predetermined sum of money in a money collection device; and
(b) pulling a rachet handle outwardly from the dispensing machine, thereby urging the first lift mechanism forward towards the front of the dispensing machine by disengaging the rachet handle from the money collection device upon receipt of said predetermined sum of money.

14. The dispensing method according to claim 13, further comprising the step of returning any excess money deposited to the user.

15. A method for individually loading a set of newspapers into a dispensing machine, having an upper compartment and a top cover encasing the top portion of the upper compartment, a transport unit housed within said upper compartment having a back plate, a lift mechanism for lifting the transport unit which includes a transport lift roller and transport lift bars, comprising the steps of:

(a) lifting the top cover, pivotally attached to the rear edge of the upper compartment, upward;
(b) urging the lift mechanism forward towards the front of the dispensing machine;
(c) engaging the lift mechanism, generally, and the transport lift roller, specifically, with the underside of the transport unit;
(d) as the transport lift bars move towards the front of the dispensing machine, pivotally urging the rear portion of the transport unit upward towards the top of the machine, thus tilting the transport unit outwardly;
(e) concurrently urging the back plate to the back of the transport unit;
(f) loading a set of newspapers into said dispensing machine in a vertical orientation;
(g) closing the top cover; and
(h) reversing the process and returning the dispensing machine to its initial operating position.

16. A method for individually loading a set of magazines into a dispensing machine, having an upper compartment and a top cover encasing the top portion of the upper compartment, a transport unit housed within said upper compartment having a back plate, a lift mechanism for lifting the transport unit which includes a transport lift roller and transport lift bars, comprising the steps of:

(a) lifting the top cover, pivotally attached to the rear edge of the upper compartment, upward;
(b) urging the lift mechanism forward towards the front of the dispensing machine;
(c) engaging the lift mechanism, generally, and the transport lift roller, specifically, with the underside of the transport unit;
(d) as the transport lift bars move towards the front of the dispensing machine, pivotally urging the rear portion of the transport unit upward towards the top of the machine, thus tilting the transport unit outwardly;
(e) concurrently urging the back plate to the back of the transport unit;
(f) loading a set of magazines into said dispensing machine in a vertical orientation;
(g) closing the top cover; and
(h) reversing the process and returning the dispensing machine to its initial operating position.

* * * * *